US007055611B2

(12) United States Patent
Pedersen et al.

(10) Patent No.: US 7,055,611 B2
(45) **Date of Patent: *Jun. 6, 2006**

(54) PLUG-DROPPING CONTAINER FOR RELEASING A PLUG INTO A WELLBORE

(75) Inventors: Gerald D. Pedersen, Houston, TX (US); David E. Hirth, Pasadena, TX (US)

(73) Assignee: Weatherford / Lamb, Inc., Houston, TX (US)

( * ) Notice: Subject to any disclaimer, the term of this patent is extended or adjusted under 35 U.S.C. 154(b) by 224 days.

This patent is subject to a terminal disclaimer.

(21) Appl. No.: 10/616,643

(22) Filed: Jul. 10, 2003

(65) Prior Publication Data

US 2004/0055741 A1 Mar. 25, 2004

Related U.S. Application Data

(63) Continuation-in-part of application No. 10/066,460, filed on Jan. 31, 2002, now Pat. No. 6,672,384.

(51) Int. Cl.
*E21B 33/05* (2006.01)
*E21B 34/06* (2006.01)

(52) U.S. Cl. ..... 166/386; 166/75.15; 166/87.1; 166/97.1; 166/330

(58) Field of Classification Search ..... 166/311, 166/381, 386, 75.11, 86.1, 86.2, 87.1, 75.15, 166/70, 95.1, 97.1, 153, 177.4, 316, 330
See application file for complete search history.

(56) References Cited

U.S. PATENT DOCUMENTS

| | | | | |
|---|---|---|---|---|
| 1,827,257 A | | 10/1931 | Parker | |
| 2,630,179 A | | 3/1953 | Brown | 166/291 |
| 3,086,587 A | | 4/1963 | Zandmer et al. | 166/284 |
| 3,444,928 A | | 5/1969 | Pitts | 166/70 |
| 3,509,913 A | * | 5/1970 | Lewis | 137/614.11 |
| 3,955,624 A | * | 5/1976 | Fredd et al. | 166/72 |
| 3,971,436 A | * | 7/1976 | Lee | 166/70 |
| 4,033,408 A | * | 7/1977 | Fredd et al. | 166/75.15 |
| 4,164,980 A | | 8/1979 | Duke | 166/291 |

(Continued)

FOREIGN PATENT DOCUMENTS

| | | |
|---|---|---|
| EP | 0 969 183 A2 | 1/2000 |
| GB | 2378200 | 2/2003 |
| GB | 2392938 | 3/2004 |
| WO | WO 03/064810 | 8/2003 |

OTHER PUBLICATIONS

U.S. Appl. No. 10/208,568, filed Jul. 30, 2002, Pedersen, et al., "Ball Dropping Assembly.".

(Continued)

*Primary Examiner*—Jennifer H. Gay
(74) *Attorney, Agent, or Firm*—Patterson & Sheridan LLP

(57) ABSTRACT

A plug-dropping container used for releasing plugs or other objects into a wellbore during fluid circulation procedures. In one aspect, the plug-dropping container is used as part of a cementing head. The plug-dropping container comprises an elongated housing, and a canister disposed co-axially within the housing. The canister is configured to receive the plug, such as a drill pipe dart. A valve is disposed below the canister. The valve is movable from a plug-retained position where the plug is blocked, to a plug-released position where the plug may be released into the wellbore there below. In the plug-retained position, fluid is permitted to flow through the canister-housing annulus and around the valve.

50 Claims, 13 Drawing Sheets

U.S. PATENT DOCUMENTS

| | | | | |
|---|---|---|---|---|
| 4,421,171 | A * | 12/1983 | Haynes | 166/331 |
| 4,427,065 | A | 1/1984 | Watson | 166/250 |
| 4,491,177 | A | 1/1985 | Baugh | 166/75 R |
| 4,674,573 | A | 6/1987 | Bode | 166/291 |
| 4,782,894 | A | 11/1988 | LaFleur | 166/70 |
| 4,917,184 | A | 4/1990 | Freeman et al. | 166/285 |
| 5,236,035 | A | 8/1993 | Brisco et al. | 166/70 |
| 5,338,001 | A * | 8/1994 | Godfrey et al. | 251/58 |
| 5,443,122 | A | 8/1995 | Brisco | 166/285 |
| 5,553,667 | A | 9/1996 | Budde et al. | 166/70 |
| 5,758,726 | A | 6/1998 | Streich et al. | 166/379 |
| 5,833,002 | A | 11/1998 | Holcombe | 166/291 |
| 5,890,537 | A | 4/1999 | Lavaure et al. | 166/285 |
| 5,950,724 | A | 9/1999 | Giebeler | 166/70 |
| 5,960,881 | A | 10/1999 | Allamon et al. | 166/291 |
| 6,182,752 | B1 * | 2/2001 | Smith et al. | 166/70 |
| 6,206,095 | B1 | 3/2001 | Baugh | 166/70 |
| 6,220,360 | B1 | 4/2001 | Connell et al. | 166/373 |
| 6,279,654 | B1 | 8/2001 | Mosing et al. | 166/285 |
| 6,311,711 | B1 | 11/2001 | Skoglund | 137/2 |
| 6,672,384 | B1 | 1/2004 | Pedersen et al. | |
| 2003/0024701 | A1 * | 2/2003 | Simson | 166/291 |
| 2003/0132002 | A1 * | 7/2003 | Giebeler et al. | 166/365 |
| 2003/0141052 | A1 * | 7/2003 | Pedersen et al. | 166/70 |
| 2004/0055741 | A1 | 3/2004 | Pedersen et al. | |

OTHER PUBLICATIONS

U.S. Appl. No. 10/081,062, filed Feb. 21, 2002, Pedersen, et al. "Ball Dropping Assembly.".

Liner Hangers, Bestline Liner Systems, Inc., 2000/2001 General Catalog, Bakersfield, CA, E-mail: bestlinelinersystems.com, 3 Pages.

Cementing Manifold & Wiper Plugs, Applied Technologies, Inc. (ATI), 1 Page.

Liner Hangers, Open Hole Completion Systems, Baker Oil Tools, 6 Pages.

PCT International Search Report, International Application No. PCT/GB03/00307, dated May 21, 2003.

U.K. Search Report, Application No. GB 0415300.3, dated Nov. 19, 2004.

U.K. Office Action, Application No. GB0326103.9, dated Jan. 19, 2005.

* cited by examiner

PLUG-DROPPING CONTAINER FOR RELEASING A PLUG INTO A WELLBORE

RELATED APPLICATIONS

This application is a continuation-in-part of an earlier application entitled "PLUG-DROPPING CONTAINER FOR RELEASING A PLUG INTO A WELLBORE."

That application was filed on Jan. 31, 2002, and has U.S. Ser. No. 10/066,460, now U.S. Pat. No. 6,672,384. The parent application is incorporated herein in its entirety by reference.

BACKGROUND OF THE INVENTION

1. Field of the Invention

The present invention generally relates to an apparatus for dropping plugs into a wellbore. More particularly, the invention relates to a plug-dropping container for releasing plugs and other objects into a wellbore, such as during cementing operations.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing. Afterwards, the second casing string is also cemented. This process is typically repeated with additional liner strings until the well has been drilled to total depth. In this manner, wells are typically formed with two or more strings of casing of an ever-decreasing diameter.

In the process of forming a wellbore, it is sometimes desirable to utilize various plugs. Plugs typically define an elongated elastomeric body used to separate fluids pumped into a wellbore. Plugs are commonly used, for example, during the cementing operations for a liner.

The process of cementing a liner into a wellbore typically involves the use of liner wiper plugs and drill-pipe darts. A liner wiper plug is typically located inside the top of a liner, and is lowered into the wellbore with the liner at the bottom of a working string. The liner wiper plug has radial wipers to contact and wipe the inside of the liner as the plug travels down the liner. The liner wiper plug has a cylindrical bore through it to allow passage of fluids.

After a sufficient volume of circulating fluid or cement has been placed into the wellbore, a drill pipe dart or pump-down plug, is deployed. Using drilling mud, cement, or other displacement fluid, the dart is pumped into the working string. As the dart travels downhole, it seats against the liner wiper plug, closing off the internal bore through the liner wiper plug. Hydraulic pressure above the dart forces the dart and the wiper plug to dislodge from the bottom of the working string and to be pumped down the liner together. This forces the circulating fluid or cement that is ahead of the wiper plug and dart to travel down the liner and out into the liner annulus.

Typically, darts used during a cementing operation are held at the surface by plug-dropping containers. The plug-dropping container is incorporated into the cementing head above the wellbore. Fluid is directed to bypass the plug within the container until it is ready for release, at which time the fluid is directed to flow behind the plug and force it downhole. Existing plug-dropping containers, such as cementing heads, utilize a variety of designs for allowing fluid to bypass the plug before it is released. One design used is an externally plumbed bypass connected to the bore body of the container. The external bypass directs the fluid to enter the bore at a point below the plug position. When the plug is ready for release, an external valve is actuated to direct the fluid to enter the bore at a point above the plug, thereby releasing the plug into the wellbore.

Another commonly used design is an internal bypass system having a second bore in the main body of the cementing head. In this design, fluid is directed to flow into the bypass until a plug is ready for release. Thereafter, an internal valve is actuated and the flow is directed on to the plug.

There are disadvantages to both the external and internal bypass plug container systems. Externally plumbed bypasses are bulky because of the external manifold used for directing fluid. Because it is often necessary to rotate or reciprocate the plug container, or cementing head, during operation, it is desirable to maintain a compact plug container without unnecessary projections extending from the bore body. As for the internal bypass, an internal bypass requires costly machining and an internal valve to direct fluid flow. Additionally, the internal valve is subject to erosion by cement and drilling fluid.

In another prior art arrangement, a canister containing a plug is placed inside the bore of the plug container. The canister initially sits on a plunger. Fluid is allowed to bypass the canister and plunger until the plug is ready for release. Upon release from the plunger, the canister is forced downward by gravity and/or fluid flow and lands on a seat. The seat is designed to stop the fluid from flowing around the canister and to redirect the flow in to the canister in order to release the plug. However, this design does not utilize a positive release mechanism wherein the plug is released directly. If the cement and debris is not cleaned out of the bore, downward movement of the canister is impeded. This, in turn, will prevent the canister from landing on the seat so as to close off the bypass. If the bypass is not closed off, the fluid is not redirected through the canister to force the plug into the wellbore. As a result, the plug is retained in the canister even though the canister is "released."

The release mechanism in some of the container designs described above involves a threaded plunger that extends out from the bore body of the container, and requires many turns to release the plug. The plunger adds to the bulkiness of the container and increases the possibility of damage to the head member of the plug container. Furthermore, cross-holes are machined in the main body for plunger attachment. Because a plug container typically carries a heavy load due to the large amount of tubular joints hanging below it, it is desirable to minimize the size of the cross-holes because of their adverse effect on the tensile strength of the container.

In order to overcome the above obstacles, plug-dropping containers have been developed that allow release of a dart by rotating a cylindrical valve that allows the dart to pass through an internal channel and at the same time redirect the flow path to be through the canister. Known plug dropping containers of this configuration have valve designs that are complex to manufacture and require the flow to traverse a tortuous and often restricting path in the bypass position.

An example of such a plug-dropping container is shown at 100 in the Prior Art view of FIG. 1. The plug-dropping container 100 first comprises a housing 120. The housing 120 defines a tubular body having a top end, a bottom end, and having a fluid channel 122 therebetween. In FIG. 1, the housing 120 is shown disposed within a cementing head 10. The upper end of the housing 120 may be threadedly connected to an upper body portion 20 of the cementing head 10, or may be integral as shown in FIG. 1. This exemplary plug-dropping container of FIG. 1 is shown in FIG. 3 of U.S. Pat. No. 5,890,537 issued to Lavaure, et al. in 1999, and is described more fully therein.

Disposed generally co-axially within the housing 120 is a canister 130. The canister 130 is likewise a tubular shaped member which resides within the housing 120 of the plug-dropping container 100. This means that the outer diameter of the canister 130 is less than the inner diameter of the housing 120. At the same time, the inner diameter of the canister 130 is dimensioned to generally match the inner diameter of fluid flow channel 22 for the cementing head 10. As with the housing 120, the canister 130 has a top opening and a bottom opening. In the arrangement shown in FIG. 1, the top opening of the canister 130 is in fluid communication with the upper fluid flow channel 22. A simple slip fit is typically provided. The canister 130 has a fluid flow channel 132 placed along its longitudinal axis. The fluid flow channels 122, 132 for the housing 120 and for the canister 130, respectively, are co-axial with the fluid flow channel 22 for the cementing head 10.

A dart 80 is shown placed within the canister 130. The dart 80 is retained within the canister 130 by a plug-retaining valve 140 (shown more fully in FIGS. 2A–2B). The purpose of the plug-retaining valve 140 is to allow the drilling operator to selectively release a dart 80 or other plug into the wellbore. To this end, the valve 140 is constructed to have a plug-retained position, and a plug-released position. Fluid circulation is maintained in both positions of the valve 140.

A bypass area 36 is provided above the canister 130. The bypass area 36 permits fluid to be diverted into an annular region 126 around the canister 130 when the valve 140 is in its plug-retained position.

FIG. 2A presents an isometric view of the plug-retaining valve 140 designed to fit into the opening 40 in the plug-dropping container 100 of FIG. 1. FIG. 2B is a longitudinal cross-sectional view of the prior art valve 140 of FIG. 2A, with the view taken across line B—B of FIG. 2A.

The valve 140 defines a short, cylindrical body having walls 144, 144'. The walls 144, 144' have an essentially circular cross-section. The wall 144' is configured to inhibit the flow of fluids from the canister 130 when the valve 140 is rotated to its plug-retained position.

Various openings are provided along the walls 144, 144' of the plug-retaining valve 140. First, one or more bypass openings 148 are placed at ends of the valve 140. FIG. 2A presents a pair of bypass openings 148. The bypass openings 148 are also seen in the FIG. 2B, which is a cross-sectional view of the plug-retaining valve 140 taken across line B—B of FIG. 2A. The bypass openings 148 receive fluid from the housing-canister annulus 122 when the valve 140 is in its plug-retained position. From there, fluid exits the valve 140 into the lower channel 32.

The plug-retaining valve 140 is designed to be rotated about a pivoting connection between plug-retained and plug-released positions. Rotation is preferably accomplished by turning a shaft 47 (shown in FIG. 1).

The plug-retaining device 140 also has a fluid channel 146 fabricated therein. The fluid channel 146 is oriented normal to the longitudinal axis of the valve 140. In addition, the longitudinal axis of the channel 146 is normal to the axis of rotation of the plug-retaining device 100 when rotating between the plug-retained and plug-released positions. The channel 146 is dimensioned to receive the dart 80 when the plug-retaining device 140 is rotated into its plug-released position during a cementing or other fluid circulation operation. The channel 146 is seen in the isometric view of FIG. 2A, as well as in the cross-sectional view of FIG. 2B.

The housing for the plug-retaining valve 140 from the prior art is cumbersome to manufacture. In this respect, the housing for the valve 140 requires extensive machining to form mating bores for openings 148.

Therefore, there is a need for plug-dropping container for a cementing head having an improved plug-retaining mechanism. There is a further need for a. plug-dropping container that is easier and less expensive to manufacture. Still further, there is a need for a plug-dropping container that provides a less restrictive and less tortuous fluid flow path in its plug-retained position.

SUMMARY OF THE INVENTION

The present invention generally relates to a plug-dropping container for use in a wellbore circulating operation. An example of such an operation is a cementing operation for a liner string. The plug-dropping container first comprises a tubular housing having a top end and a bottom end. The top end is in sealed fluid communication with a wellbore fluid circulation device, such as a cementing head. Thus, fluid injected into the cementing head will travel through the housing before being injected into the wellbore.

The plug-dropping container also comprises a canister disposed co-axially within the housing. The canister is likewise tubular in shape so as to provide a fluid channel therein. The canister has a top opening and a bottom opening, and is dimensioned to receive plugs, such as drill pipe darts, therethrough. An annulus is defined between the canister and the surrounding housing. Un upper bypass area is formed proximal to the top end of the canister, thereby permitting fluids to flow from the cementing head, through the bypass area, and into the annular region between the canister and the surrounding housing.

A plug-retaining valve is provided proximal to the lower end of the canister. The valve is used to retain one or more plugs until release of the plug into the wellbore is desired. In this respect, the plug-retaining valve is movable between a plug-retained position where the plug is blocked, to a plug-released position where the plug may be released from the canister and into the wellbore there below.

The plug-retaining valve has a solid surface that blocks release of the plug in the plug-retained position. At the same time, and contrary to the prior art valve of FIGS. 1 and 2A–2B, the valve permits fluid to flow through the annulus and around the valve. The valve also has a channel there through that receives the plug when the valve is moved to its object-released position.

In one aspect, the plug-retaining valve is a spherical member having a fluid channel therein. One portion of the spherical valve is truncated, creating a flat surface. Thus, the plug-retaining valve is eccentrically configured so that it has a substantially flat surface, and a radial surface. The radial surface is dimensioned to substantially seal the bottom end of the canister when the plug-retaining device is in its plug-retained position.

When the plug-dropping container is in its plug-retained position, the plug-retaining valve is oriented such that the radial surface of the plug-retaining device blocks the downward flow of the dart. In this position, the dart and the plug-retaining valve prohibit the flow of fluid through the canister; instead, fluid travels through the bypass ports, around the canister, through the canister-housing annulus, around the flat surface of the valve, and into the wellbore. At the point at which plug-release is desired, the valve is rotated 90 degrees, aligning the fluid channel with the channel of the canister. At the same time, the bypass is substantially shut off by the radial surface around the perimeter of one end of the valve fluid channel closing off the gap between the valve and the upper opening of the lower head channel. The plug-retaining valve then permits both the dart and fluids to flow directly through the canister and into the wellbore.

In one aspect, a travel stop is provided to limit the rotation of the device to 90 degrees. The travel stop ensures that the radial surface of the plug-retaining valve is always blocking the dart when the valve is in its plug-retained position, and that the fluid channel is aligned with the channel in the canister when the valve is in its plug-released position.

In another embodiment, one or more plug-dropping containers of the present invention may be stacked for sequential release of more than one dart during a cementing (or other fluid circulation) operation.

BRIEF DESCRIPTION OF THE DRAWINGS

So that the manner in which the above recited features of the present invention are attained and can be understood in detail, a more particular description of the invention, briefly summarized above, may be had by reference to the appended drawings. It is to be noted, however, that the appended drawings (FIGS. 3 through 10D) illustrate only typical embodiments of this invention and are therefore not to be considered limiting of its scope, for the invention may admit to other equally effective embodiments.

DETAILED DESCRIPTION OF THE PREFERRED EMBODIMENT

Figure 3:
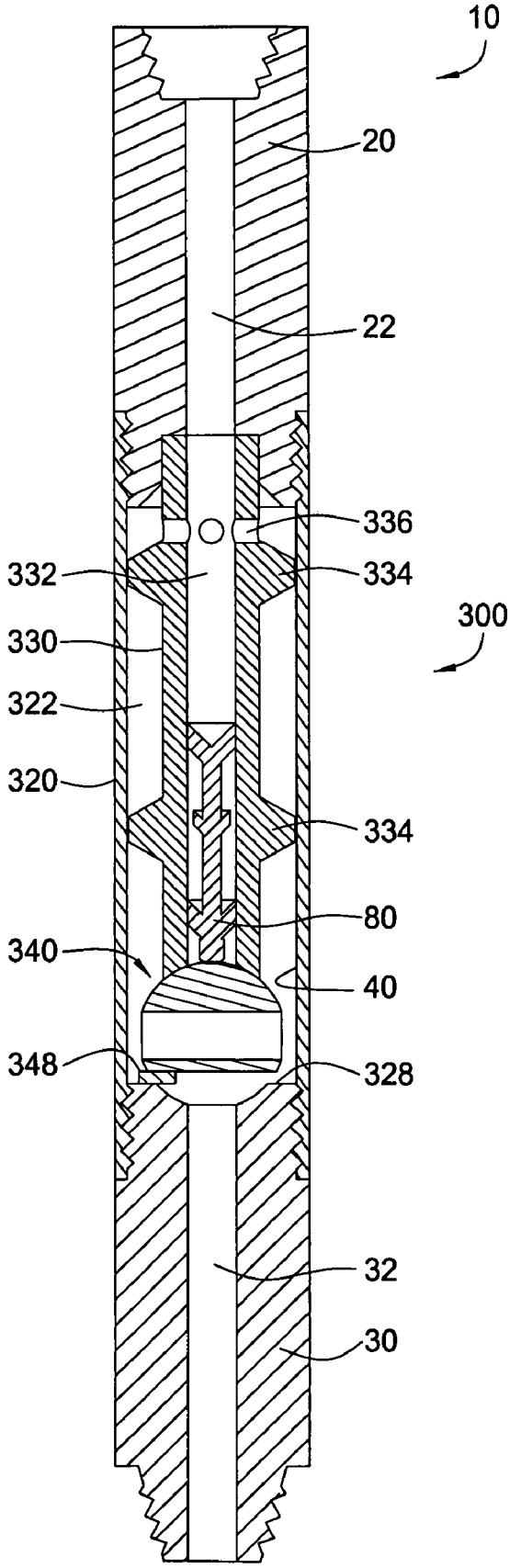
FIG. 3 is a front, cross-sectional view of a plug-dropping container of the present invention, in its plug-retained position. An upper housing, lower housing, and intermediate housing are seen. In this view, a novel plug-retaining valve is in its closed position, blocking release of a plug.

FIG. 3 presents a front view of a plug-dropping container 300 of the present invention, in one embodiment. The plug-dropping container 300 is shown in cross-section with a dart 80 disposed therein. The plug-dropping container 300 is in its plug-retained position. In this way, the dart 80 is retained within the plug-dropping container 300.

Figure 1:
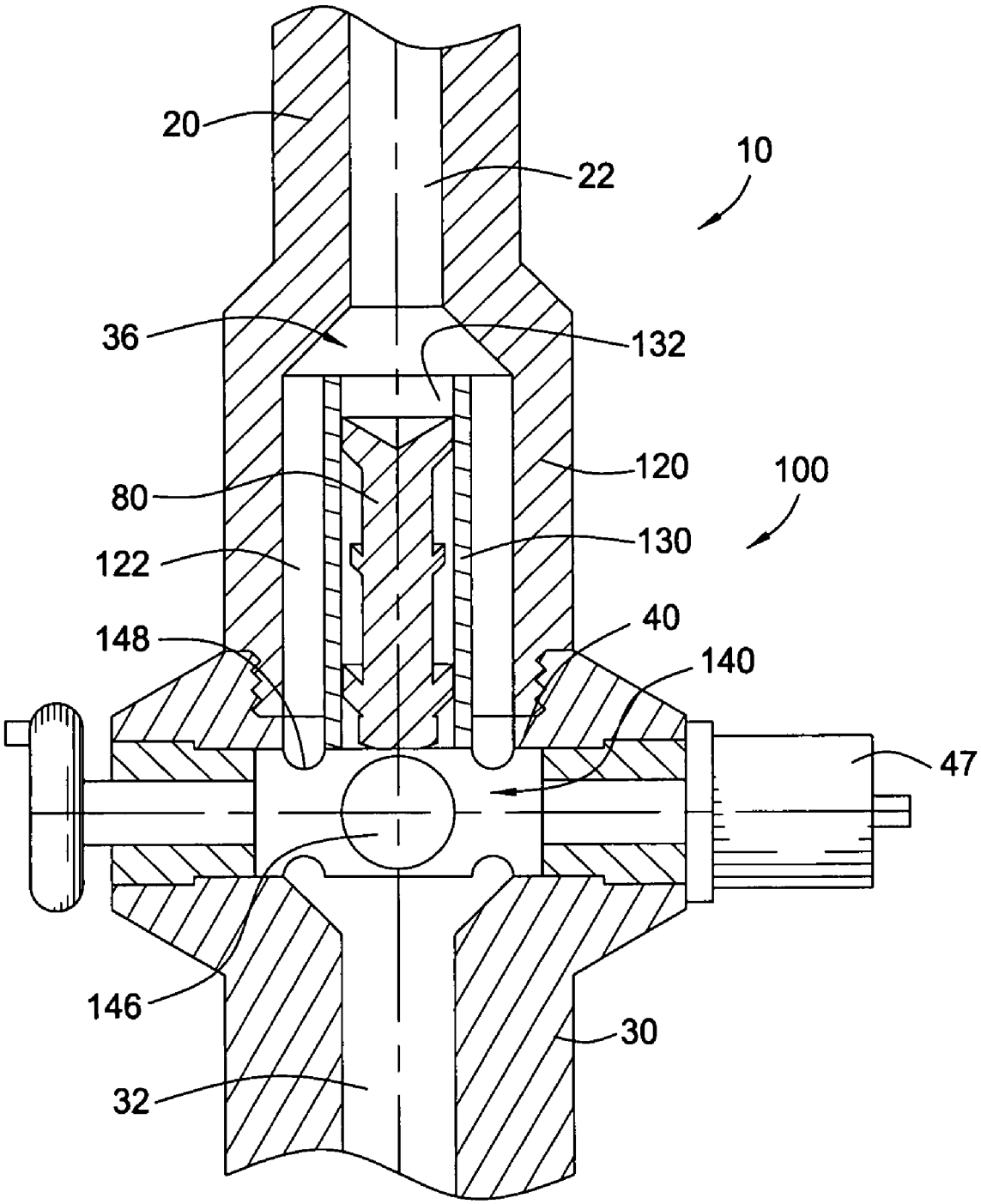
FIG. 1 (PRIOR ART)
FIG. 1 is a partial cross-sectional view of a prior art cementing head having a plug-dropping container. Visible in this view is a canister for receiving a plug such as a drill pipe dart through the cementing head Also visible is a plug-retaining valve for selectively releasing the plug into the wellbore below.
Figure 2A:
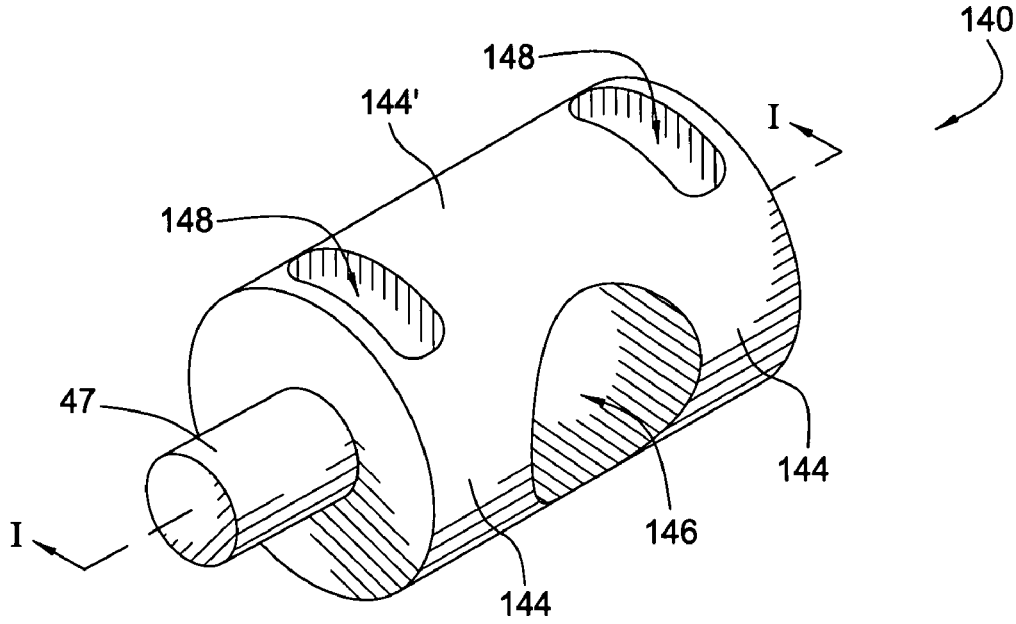
FIG. 2A (PRIOR ART)
FIG. 2A is an isometric view of the valve from the plug-dropping container of FIG. 1.
Figure 2B:
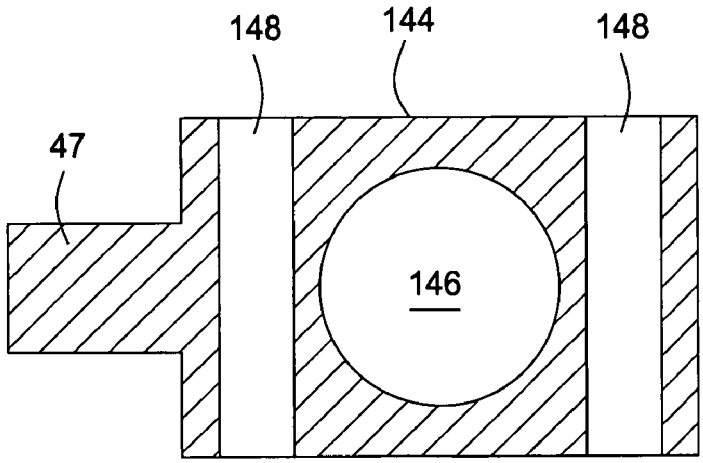
FIG. 2B (PRIOR ART)
FIG. 2B is a longitudinal cross-sectional view of the prior art valve of FIG. 2A, with the view taken across line I—I of FIG. 2A.
Figure 4:
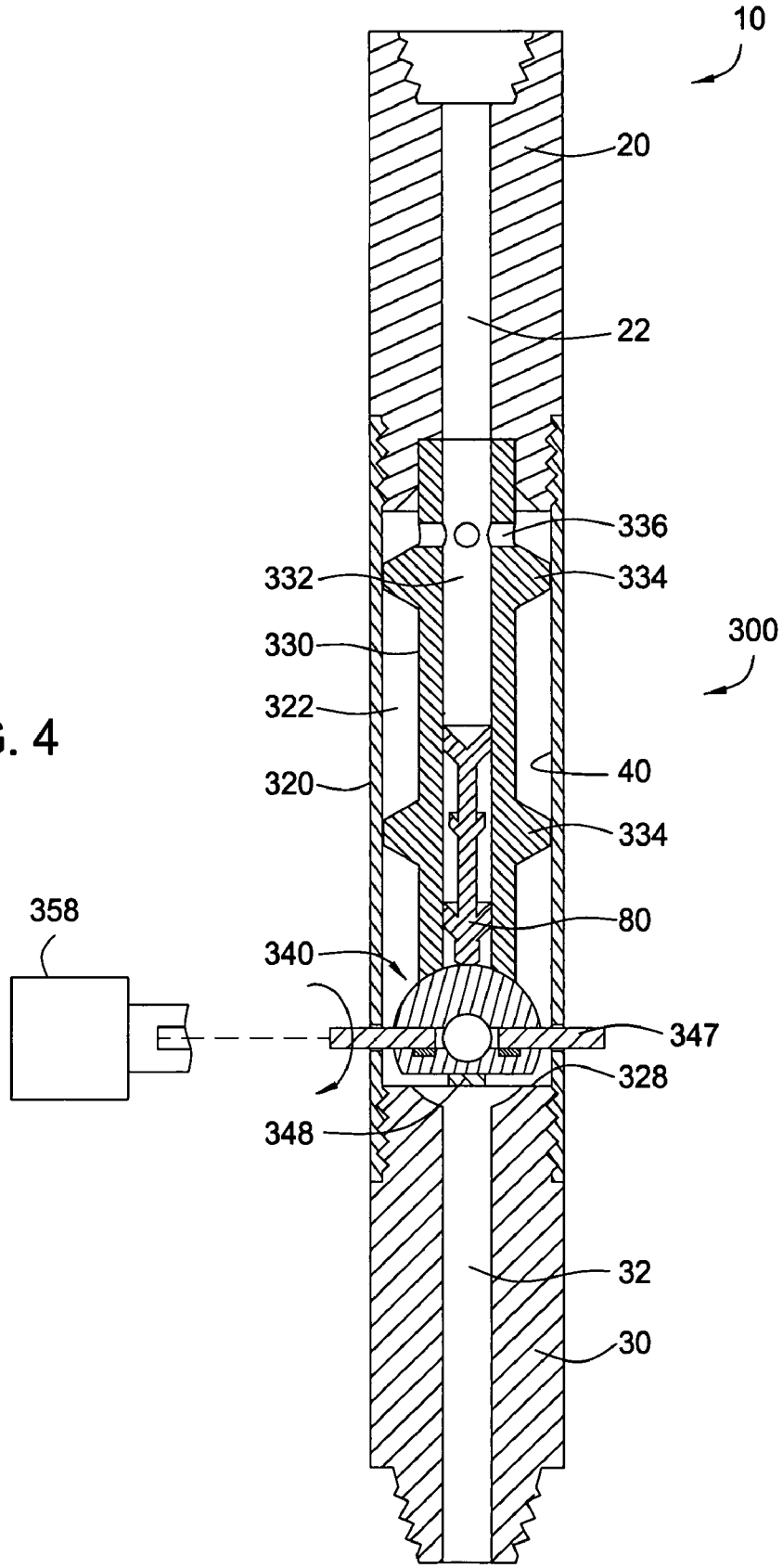
FIG. 4 is a side, cross-sectional view of the plug-dropping container of FIG. 3, in its plug-retained position.

FIG. 4 presents a side view of the plug-dropping container 300 of FIG. 1. The plug-dropping container 300 is again in its plug-retained position. The dart 80 is again seen being held within the container 300 before release into a wellbore (not shown) therebelow.

The plug-dropping container 300 is designed for use in a wellbore circulating system. An example of such a system is a cementing head 10 as might be used for cementing a liner string. The views of FIG. 3 and FIG. 4 include upper 20 and lower 30 body portions of a cementing head 10. The body portions 20, 30 include respective fluid flow channels 22, 32. The fluid flow channels 22, 32 permit fluid to be circulated from the surface into the wellbore. The plug-dropping container 300 is preferably disposed intermediate the upper 20 and lower 30 body portions, as shown in FIGS. 3 and 4.

As with the prior art plug-dropping container 100 of FIG. 1, the novel plug-dropping container 300 of FIG. 3 first comprises a housing 320. The housing 320 defines a tubular body having a top end, a bottom end, and having a fluid channel 322 therebetween. In FIG. 3, the housing 320 is shown disposed within the cementing head 10. The upper end of the housing 320 is connected to the upper body portion 20 of the cementing head 10. Likewise, the lower end of the housing 320 is connected to the lower body portion 30 of the cementing head 10. Preferably the connection is constructed so as to place the fluid flow channel 322 for the housing 320 co-axial with the fluid flow channels 22, 32 for the cementing head 10.

Disposed within the housing 320 is an elongated canister 330. The canister 330 is a tubular shaped member which resides within the housing 320 of the plug-dropping container 300. This means that the outer diameter of the canister 330 is less than the inner diameter of the housing 320. At the same time, the inner diameter of the canister 330 is dimensioned to generally match the inner diameter of the fluid flow channels 22, 32 for the cementing head 10. As with the housing 320, the canister 330 has a top opening and a bottom opening. In the arrangement shown in FIG. 3, the top opening of the canister 330 is in fluid communication with the upper fluid flow channel 22. In one aspect, a threaded connection is provided between the top end of the canister 330 and the lower end of the upper cementing head body 20. In the arrangement shown in FIG. 3, though, a simple slip fit is provided. However, it is understood that the present invention 300 is not limited as to the manner in which the canister 330 is held within the cementing head 10.

A channel 332 is formed within the canister 330 between the top and bottom ends. The channel 332 is configured to closely receive and retain a plug 80 such as a drill pipe dart when the plug-dropping container 300 is in its plug-retained position. In the view of FIG. 3, a dart 80 is being retained within the channel 332 by a novel plug-retaining valve 340. Thus, the plug-releasing container 300 is in its plug-retained position.

The canister 330 is generally co-axially aligned within the tubular housing 320. Preferably, the canister 330 is centralized within the tubular housing 320 by spacers 334 positioned between the outer wall of the canister 330 and the inner wall of the housing 320. The spacers 334 are preferably attached to the outer wall of the canister 330, as shown in FIG. 3. Alternatively, the spacers 334 may be attached to the inside of the tubular housing 320. The spacers 334 are configured so as to allow fluid to flow through the annulus.

A fluid bypass area 336 is provided proximal to the top end of the canister 330. The bypass area 336 may be simply a gap between the top of the canister 330 and the upper head member 20. In the arrangement of FIGS. 3 and 4, the bypass area 336 defines one or more bypass ports formed in the canister 330. The bypass ports 336 are disposed above the position of the dart 80 in the canister 330. The bypass ports 336 permit fluid circulating downhole to be diverted into the annular fluid channel 322 of the housing 320 (between the canister 330 and the housing 320).

The canister 330 is designed to be of a generally equivalent length as compared to the housing 320. The exact relative lengths of the housing 320 and the canister 330 are variable, so long as a spacing is provided for the plug-retaining valve 340, and to permit fluid to bypass the canister channel 332 and travel into the lower head channel 32 en route to the wellbore. In one arrangement, a gap 328 (shown in FIGS. 3 and 4) is provided under the valve 340 and above the lower cement body 30.

As with the prior art plug-dropping container 100, the plug-dropping container 300 of the present invention provides a space 40 for a plug-retaining valve. However, in the arrangement in FIGS. 3 and 4, a novel valve 340 is provided. The valve 340 is configured to permit fluid to flow around the valve 340 when the valve 340 is in its plug-retained position, rather than only through milled ports. This potentially simplifies the manufacturing process.

Figure 5C:
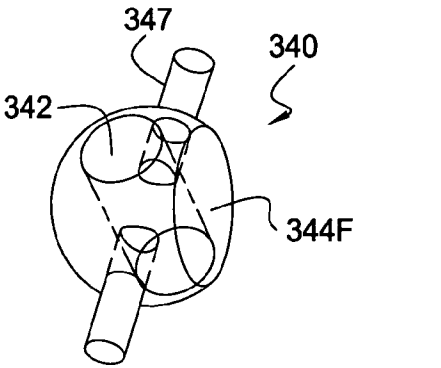
FIG. 5C is also an isometric view of the plug-retaining valve from FIG. 3. In this view, the bore through the valve is seen in phantom.
Figure 5B:
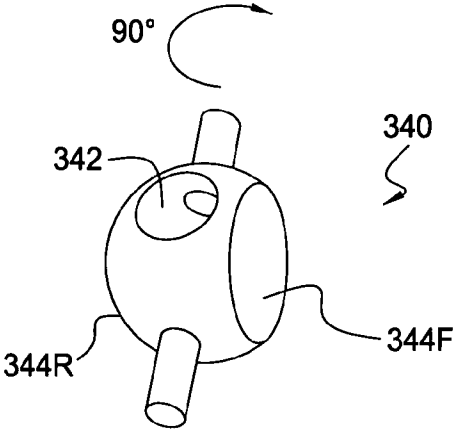
FIG. 5B presents another isometric view of the plug-retaining valve of the plug-dropping container of FIG. 3. In this view, the valve has been rotated for additional viewing of features of the valve.
Figure 5A:
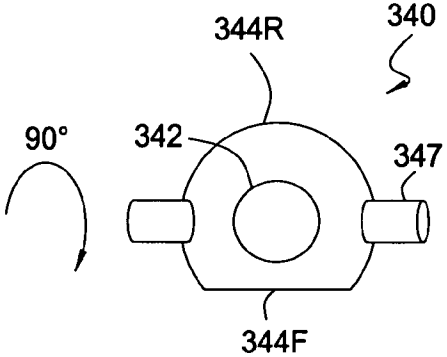
FIG. 5A is an isometric view of the plug-retaining valve of the plug-dropping container of FIG. 3. In this view, a flat side of the valve is on the bottom.

FIG. 5A presents an isometric view of the plug-retaining valve 340 of the plug-dropping container 300 of FIG. 3. In this arrangement, the valve 340 generally defines a spherical body having a radial surface 344R. The valve 340 is truncated in order to form a substantially flat surface 344F. Thus, the valve 340 has a radial surface 344R, and an opposing flat surface 344F. The radial surface 344R of the valve 340 is dimensioned to substantially seal against the canister 330 when the valve 340 is in its plug-retained orientation and to substantially close the bypass flow when the valve 340 is in its plug-released orientation. In the view of FIG. 5A, the flat surface 344F is on the bottom.

A fluid channel 342 is formed through the valve 340. The fluid channel 342 is dimensioned to closely receive a drill pipe dart 80 or other plug, permitting the dart 80 to pass through the valve 340. This occurs when the valve 340 is in its plug-released position (shown later in FIGS. 6 and 7). In one arrangement, the fluid channel 342 is axially aligned with the flat surface 344F. Also, as will be noted, the longitudinal axis of the channel 342 is normal to the axis of rotation of the valve 340 when it is rotated between plug-retained and plug-released positions.

FIGS. 5B and 5C present additional isometric views of the valve 340 of FIG. 5A. The valve 340 is rotated for clarification of the views. In FIG. 5C, the fluid channel 342 is seen in phantom.

Figure 5F:
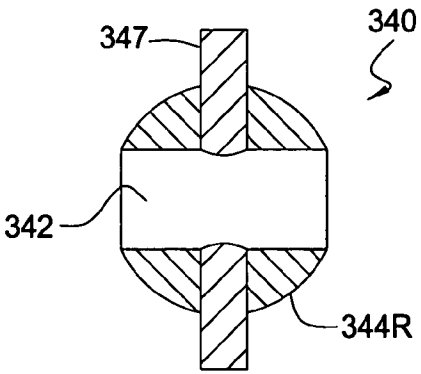
FIG. 5F represents another cross-sectional view of the plug-retaining valve of FIG. 5B. The cut is taken across line III—III of FIG. 5D.
Figure 5E:
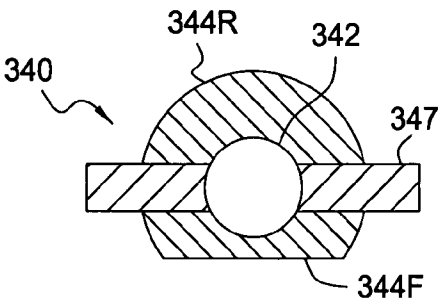
FIG. 5E is a side, cross-sectional view of the plug-retaining valve of FIG. 5B. The cut is taken across line II—II of FIG. 5D.
Figure 5D:
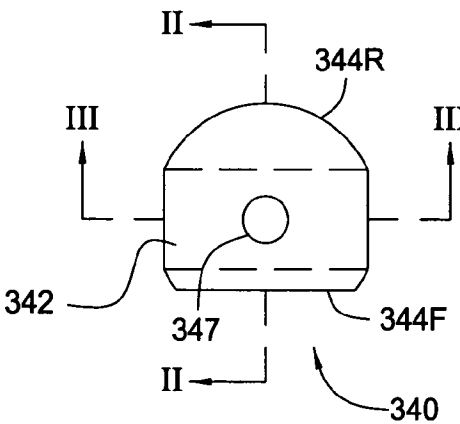
FIG. 5D is a front, perspective view of the plug-retaining valve of FIG. 5B.

FIG. 5D is a front, perspective view of the plug-retaining valve 340 of FIG. 5A. In this view, the valve 340 is oriented as in FIG. 3. This means that the valve 340 would be in its plug-retained position within the plug-dropping container 300. Visible at the top of the valve 340 in this orientation is the radial surface 344R. The flat surface 344F is at the bottom of the valve 340. The fluid channel 342 is shown in phantom.

The plug-retaining valve 340 is designed to be rotated between plug-retained and plug-released positions. To accomplish this rotation, shafts 347 project from opposing sides of the valve 340. The shafts 347 are perpendicular to the fluid channel 342. The shafts 347 extend through the wall of the cementing head 10 for turning the plug-retaining valve 340. The shaft 347 may be rotated manually. Alternatively, rotation may be power driven by a drive member 358, or may be remotely operated by a suitable motor or drive means (not shown). It is preferred that the shafts extend on opposite sides of the cementing head 10 for pressure balancing. By turning the shaft 347, an operator may rotate the plug-retaining valve 340 between plug-retained and plug-released positions. It is understood that any arrangement for rotating the plug-retaining valve 340 is within the scope of the present invention.

FIG. 5E is a side, cross-sectional view of the plug-retaining valve 340 of FIG. 5A. The cut is taken across line E—E of FIG. 5D. FIG. 5F is a cross-sectional view of the plug-retaining valve 340 of FIG. 5A. The view is taken across line F—F of FIG. 5D.

Referring back to FIG. 3, FIG. 3 again presents the plug-dropping container 300 in its plug-retained position. In this view, the radial surface 344R of the valve 340 is oriented upwards in order to block downward release of the dart 80, and to substantially seal the lower end of the canister channel 332. In this way, the downward progress of the dart 80 is blocked. It is noted that the radial surface 344R of the valve 340 is dimensioned to be able to rotate along the bottom end of the canister 330, and to substantially restrict the flow of fluids through the canister 330 when the valve 340 is in its plug-retained position. This causes fluids flowing from the upper head channel 22 to be diverted through the bypass ports 336 of the canister, and downward through the canister-housing annulus 322. From there, fluids flow around the plug-retaining valve 340 and through the gap 328 below the valve 340. Fluids then proceed into the wellbore through the channel 32 in the lower cementing head body 30.

Figure 6:
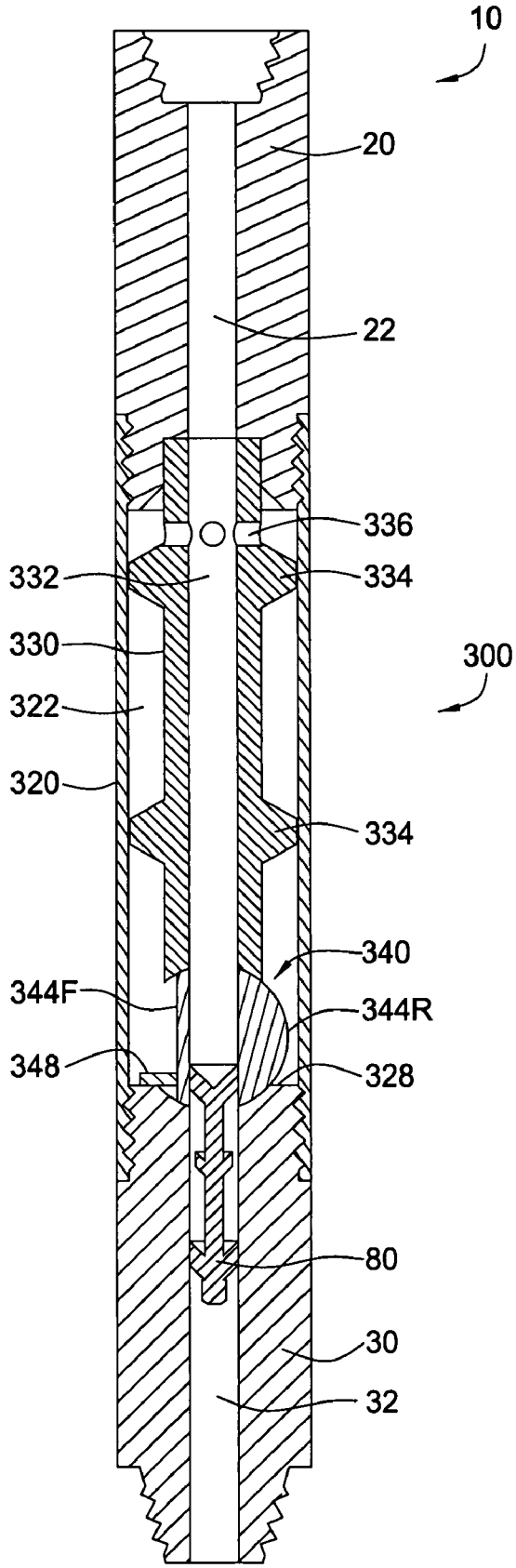
FIG. 6 is a front, cross-sectional view of the plug-dropping container of FIG. 3. In this front view, the plug-retaining-valve has been rotated to its plug-released position, allowing the dart to be released through the valve channel and down into the wellbore.

In order to release the dart 80, the plug-retaining valve 340 is rotated into its plug-released position. To accomplish this, the valve 340 is rotated 90 degrees so as to align the channel opening 342 with the canister channel 332 and the lower cementing head channel 32. The valve's 340 plug-released position is shown in FIG. 6. FIG. 6 presents a front, cross-sectional view of the plug-dropping container 300 of FIG. 3. In this front view, the valve 340 has been rotated to its plug-released position. The fluid channel 342 of the valve 340 is now aligned with the channel 332 of the canister 330, and the radial surface 344R of the valve 340 is no longer blocking downward progress of the dart 80. Further, in the plug-released position of the valve 340, the radial surface 344R is proximate to the lower body 30 substantially closing the gap 328. Thus, fluid no longer is allowed to pass through the annular fluid channel 322, but is forced to flow through the canister channel 332. This fluid flow along with gravity, forces the dart 80 downhole.

Figure 7:
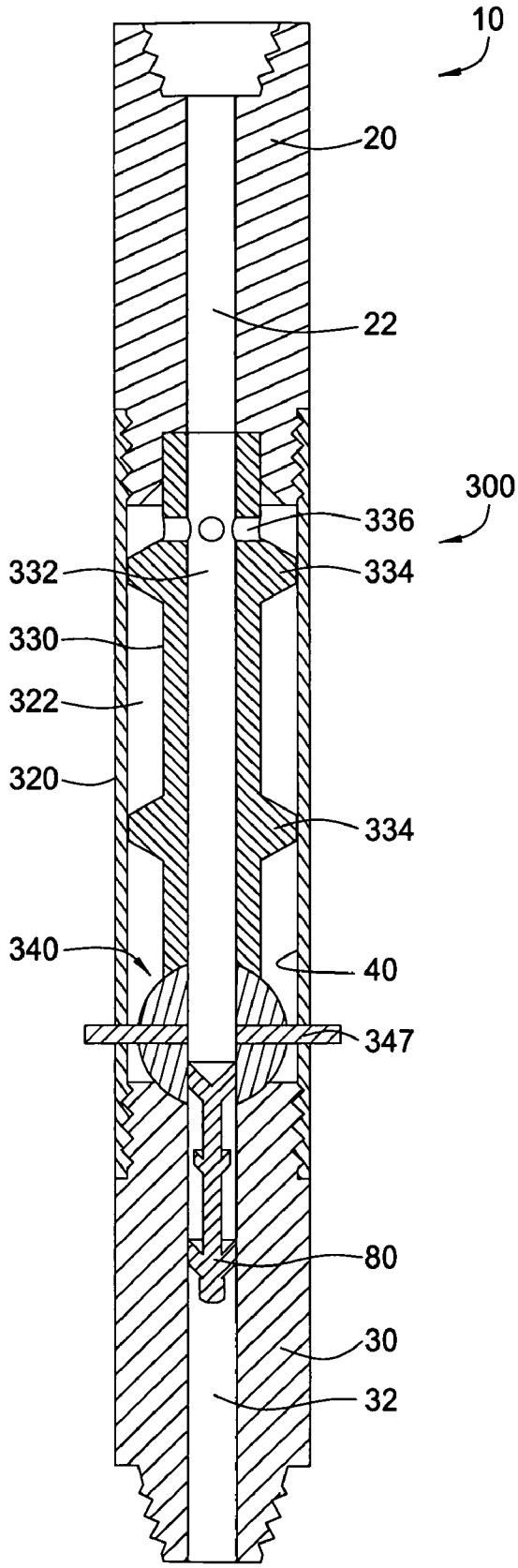
FIG. 7 is a side, cross-sectional view of the plug-dropping container of FIG. 6, in its plug-released position.

FIG. 7 is a side view of the plug-dropping container 300 of FIG. 6. The flat surface 344F of the valve 340 is not visible in this view. However, in both FIG. 6 and FIG. 7, a dart 80 is being released into the wellbore below.

A stop member 348 is optionally provided above the lower portion of the head member 30. In FIGS. 3 and 6, the stop member 348 is seen as a shoulder extending upwards from the lower head member 30. However, other arrangements for a stop member 348 may be employed. The purpose of the stop member 348 is to serve as a "no-go" or "travel stop" with respect to the rotation of the plug-retaining valve 340. The result is that the valve 340 can only be rotated 90 degrees.

Figure 8A:
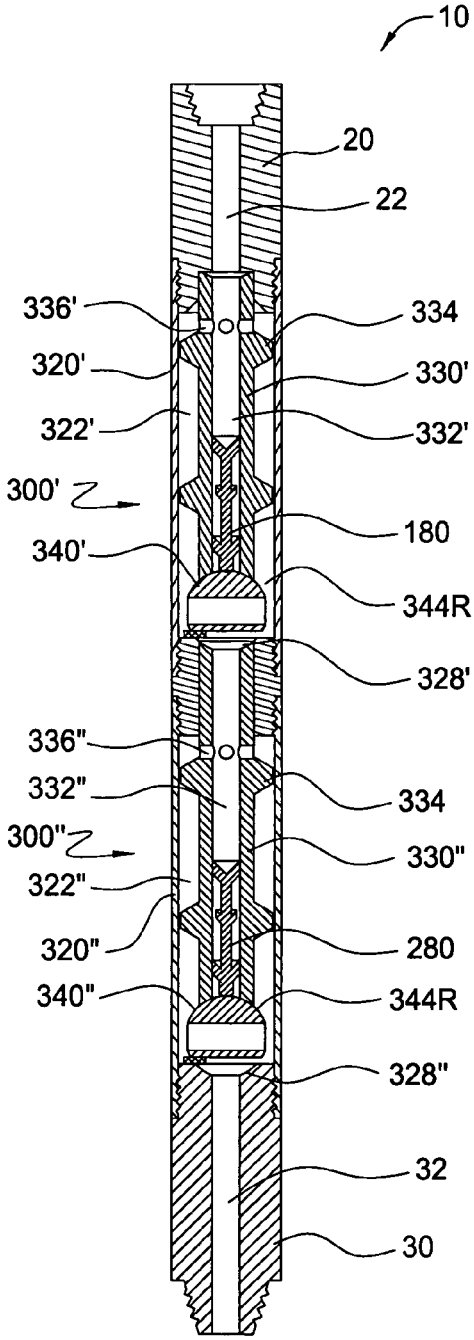
FIG. 8A is a cross-sectional view of an alternative embodiment of a plug-dropping container of the present invention. In this view, two plug-dropping containers are stacked, one on top of the other. Both plug-dropping containers are in the plug-retained position, thereby blocking the release of darts.

In many cementing operations, two plugs are released during sequential fluid circulation stages. In order to accommodate the release of two plugs, an alternate embodiment of the plug container is provided. FIG. 8A is a cross-sectional view of an alternative embodiment of a plug-dropping container of the present invention. In this view, two plug-dropping containers 300', 300" are stacked, one on top of the other. Each plug-dropping container 300', 300" is in the plug-retained position, thereby blocking the release of upper 180 and lower 280 darts.

In operation, two plug-dropping containers 300', 300" according to the present invention are disposed within a head member 10, and stacked one on top of the other. Each tool 300', 300" includes a tubular housing 320', 320", and a respective canister 330', 330" disposed within the respective housings 320', 320". Each plug-retaining tool 300', 300" also provides a valve 340', 340" for selectively retaining and releasing a dart 180, 280. The valves 340', 340" are designed in accordance with the valve 340 described above and shown in FIGS. 3 and 6.

As illustrated in FIG. 8A, the tools 300', 300" are initially in their plug-retained positions. Darts 180 and 280 are disposed in the upper 300' and lower 300" tools, respectively. Dart 180 is held within the upper canister 330' and retained by the upper valve 340'. In this respect, the upper valve 340' is rotated so that the radial surface 344R impedes the downward progress of the dart 180. This also serves to substantially inhibit the flow of fluids through the upper canister 330'. Likewise, dart 280 is held within the lower canister 330" and retained by a lower valve 340". In this respect, the lower valve 340" is also rotated so that the radial surface 344R impedes the downward progress of the dart 280. This also serves to substantially inhibit the flow of fluids through the lower canister 330".

The top of the upper housing 320' is fluidly connected to the bottom of the upper head body 20. The bottom of the lower housing 320" is fluidly connected to the top of the lower head body 30. Intermediate the upper and lower head bodies 20, 30 the upper and lower housings 320', 320" are connected. In the arrangement of FIG. 8A, the bottom end of the upper housing 320' is threadedly connected to the top end of the lower housing 320". In this way, the upper and lower housings 320', 320" essentially form a single tubular housing. Centralizers 334 are optionally placed around the upper 330' and lower 330" canisters, respectively, to aid in centralizing the canisters 330', 330" within the respective housings 320', 320".

In operation, drilling fluid, or other circulating fluid, is introduced into the upper cementing head body 20 through a fluid flow channel 22. Because the upper valve 340' is in its plug-retained position, fluid is not able to flow through the upper canister 330'. A fluid bypass area 336' is provided proximal to the top end of the canister 330'. The bypass area 336' may be simply a gap between the top of the canister 330' and the upper head member 20. In the arrangement shown the bypass area defines bypass ports 336' placed in the upper canister 330', permitting fluid to flow around the upper canister 330' and through an upper fluid flow channel 322' of the upper housing 320'. Preferably, the bypass ports 336' are proximate to the top end of the upper canister 330'.

The upper housing fluid flow channel 322' defines the annular region between the upper canister 330' and the upper housing 320'. From there, fluid travels around the upper valve 340', and enters a gap 328' below the upper valve 340'. Fluid then enters the lower canister 330" of the lower tool 300".

It is again noted that the lower valve 340" is also in its plug-retained position. This means that fluid is not able to flow through the lower canister 330", at least not in any meaningful fashion. A fluid bypass area 336" is provided proximal to the top end of the canister 330". The bypass area 336' may be simply a gap between the top of the canister 330" and the upper head member 20. In the arrangement shown, one or more bypass ports 336" are placed proximate to the top of the lower canister 330". The bypass ports 336" allow fluid to progress downwardly through the fluid channel 322" of the lower housing 320". From there, fluid exits a lower gap 328" disposed below the lower valve 340". Fluid then enters the fluid channel 32 in the lower head body 30. The lower head body 30 may be a tubular in a cementing head or may be the wellbore itself. In one aspect of the present invention, the lower bore 32 defines the upper portion of the wellbore.

Figure 8B:
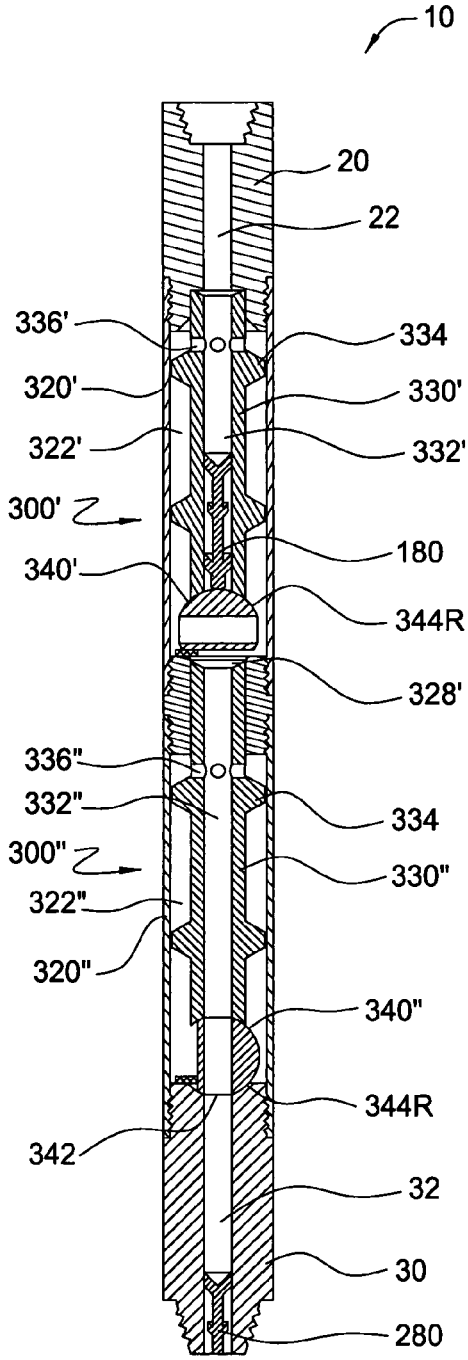
FIG. 8B is a schematic view of the plug-dropping container of FIG. 8A. In this view, the lower plug-retaining valve has been rotated to release the lower dart.

The bottom plug 280 is disposed in the lower canister 330" to be released into the wellbore. The bottom plug 280 may be used to clean the drill string or other piping of drilling fluid and to separate the cement from the drilling fluid. Release of the bottom plug 280 is illustrated in FIG. 8B. To release the bottom plug 280, the lower plug-retaining valve 340" is rotated by approximately 90 degrees. Rotation may be in accordance with any of the methods discussed above. The plug-retaining valve 340" is rotated to align the fluid channel 342 of the lower valve 340" with the fluid channel 332" of the lower canister 330". In this manner, the plug-retaining valve 340" is moved from a plug-retained position to a plug-released position such that the radial surface 344R of the bottom plug-retaining valve 340" no longer blocks downward travel of the bottom plug 280.

It should be noted that rotation of the lower valve 340" to its plug-released position closes off the lower gap 328". In this way, fluids cannot continue to flow through the lower canister-housing annulus 322", but flow through the channel 342 of the lower valve 340". This, in turn, forces fluid flowing from the surface to travel through the lower canister 330", thereby forcing the lower dart 280 into the wellbore.

The bottom plug 280 travels down the wellbore and wipes the drilling fluid from the drill string with its wipers. In one use, the bottom plug 280 is forced downhole by injection of cement until it contacts a wiper plug (not shown) previously placed in the top of a liner.

Figure 8C:
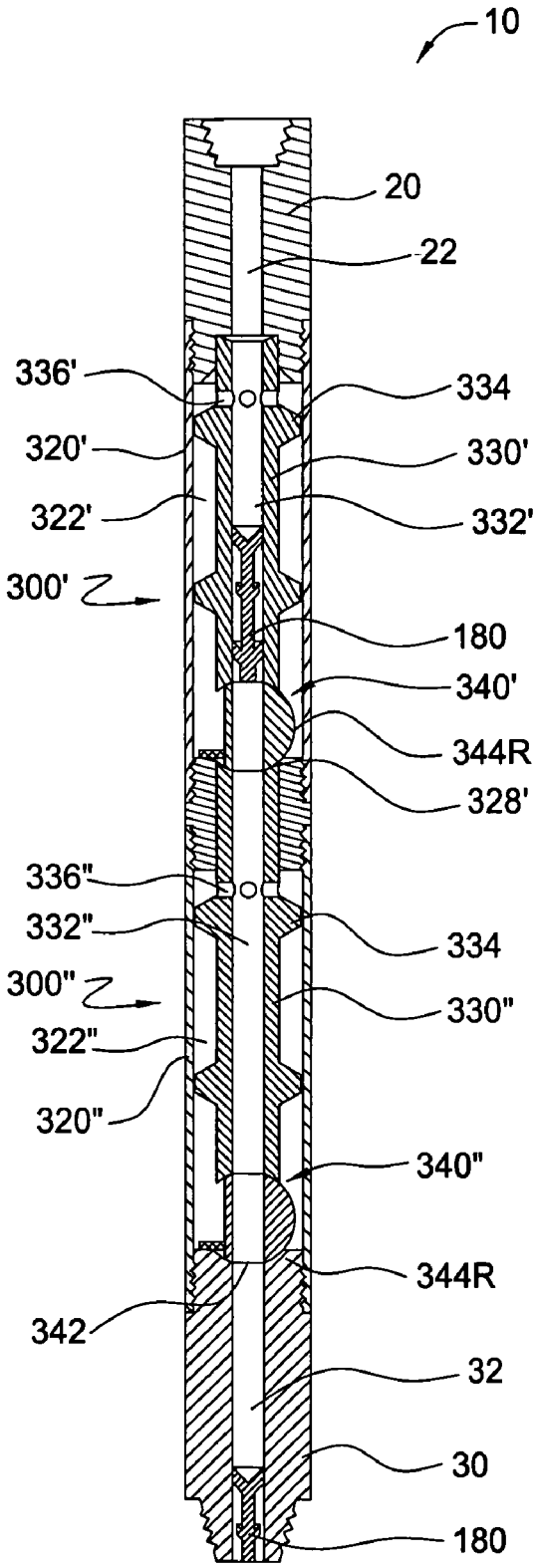
FIG. 8C is a schematic view of the plug-dropping container of FIG. 8B. Again, two plug-dropping containers are stacked one on top of the other. In this view, the upper plug-retaining valve has been rotated to release the top dart into the wellbore.

After the lower plug 280 has been released, the upper plug 180 remains in the upper plug-retaining tool 300'. It may be desirable to later release the upper plug 180 into the wellbore as well. For example, the upper plug 180 could be used to separate a column of cement from a displacement fluid. Thus, after a sufficient amount of cement is supplied to fill the annular space behind the liner (not shown), the top plug 180 is released behind the cement. In this instance, drilling fluid is pumped in behind the top plug 180. The top plug 180 separates the two fluids and cleans the drill string or other piping of cement. Release of the upper plug 180 is illustrated in FIG. 8C.

To release the top plug 180, the plug-retaining valve 340' of the upper tubular housing 320' is rotated by approximately 90 degrees. Rotation again may be in accordance with any of the methods discussed above. Rotation aligns the plug-retaining valve channel 342 of the upper plug retaining valve 340' with the upper canister channel 332', as illustrated in FIG. 8C. After rotation, the radial surface 344R of the upper plug-retaining valve 340' no longer blocks downward travel of the top plug 180. In this manner, the upper plug-retaining valve 340' is moved from a plug-retained position to a plug-released position. Rotation of the upper valve 340' to its plug-released position closes off the upper gap 328'. In this way, fluids cannot continue to flow through the upper canister-housing annulus 322' and into the lower canister 330". This, in turn, forces drilling mud or other fluid flowing from the surface to travel through the upper canister 330', thereby forcing the upper dart 180 into the wellbore. The top plug 180 then travels through the channel 342 of the upper plug-retaining valve 340' and continues down through the lower canister channel 332", and the channel 342 of the lower plug-retaining valve 340". The top plug 180 exits into the lower bore 32 and continues into the wellbore with the drilling mud immediately behind it.

Figure 9A:
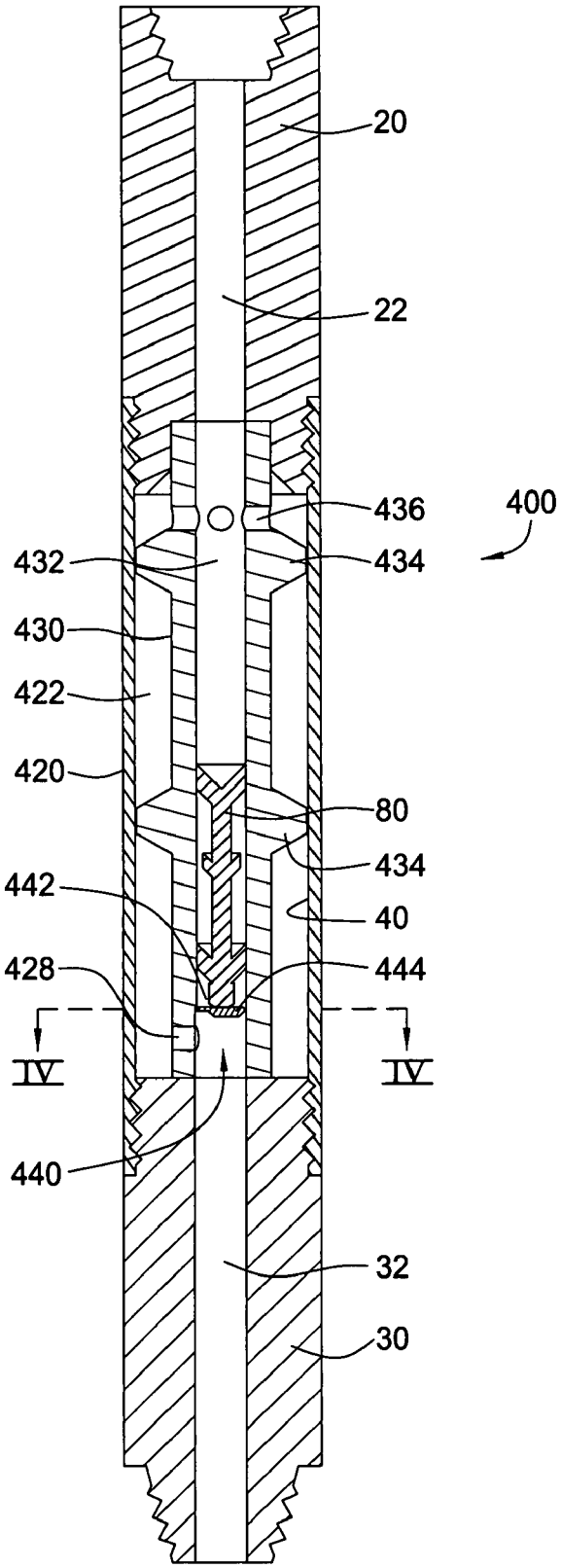
FIG. 9A is a cross-sectional view of still another embodiment of a plug-dropping container 400 of the present invention. In this arrangement, the plug-retaining device 440 is a flapper valve. Here, the valve 440 is in its closed position, preventing the downward release of the dart 80. The canister 430 is centralized within a tubular housing 420 by a spacer 434 (centralizer) and an annulus 422 is formed between the canister 430 and the housing 420. The canister 430 extends downward below the valve 440. An upper bypass port 436 is formed in the canister 430 and a lower bypass port 428 is milled into the canister 430 below the valve 440. The valve 440 preferably contains a curved flapper 444, having an outer diameter that is dimensioned to match the canister's 430 inner diameter. The flapper 444 mates with a seat 442. The seat 442 is formed in the canister 430 and serves as the channel for the valve 440.

FIG. 9A is a cross-sectional view of still another embodiment of a plug-dropping container 400 of the present invention. In this arrangement, the plug-retaining device 440 is a flapper valve. Here, the valve 440 is in its closed position, preventing the downward release of the dart 80. The canister 430 extends downward below the valve 440. A lower bypass port 428 is milled into the canister 430 below the valve 440. The valve 440 preferably contains a curved flapper 444, having an outer diameter that is dimensioned to match the canister's 430 inner diameter. The flapper 444 mates with a seat 442. The seat 442 is formed in the canister 430 and serves as the channel for the valve 440.

Figure 9B:
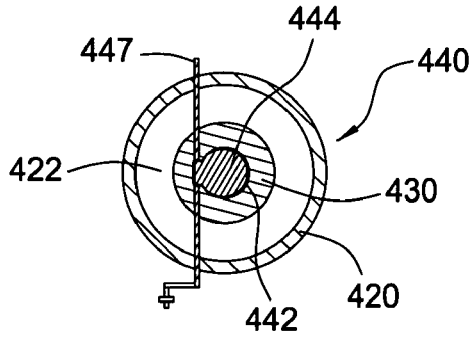
FIG. 9B presents a transverse view of the plug-dropping container of FIG. 9A. The view is taken through line IV—IV of FIG. 9A. Visible in this view is the flapper, and a shaft for rotating the flapper.

The flapper 444 is designed to pivot from a plug-retained position to a plug-released position. To this end, a shaft 447 is provided for rotating the flapper 444. FIG. 9B presents a transverse view of the plug-dropping container 400 of FIG. 9A. The view is taken through line B—B of FIG. 9A. Visible in this view is the flapper 444, and the shaft 447 for rotating the flapper 444.

Figure 9C:
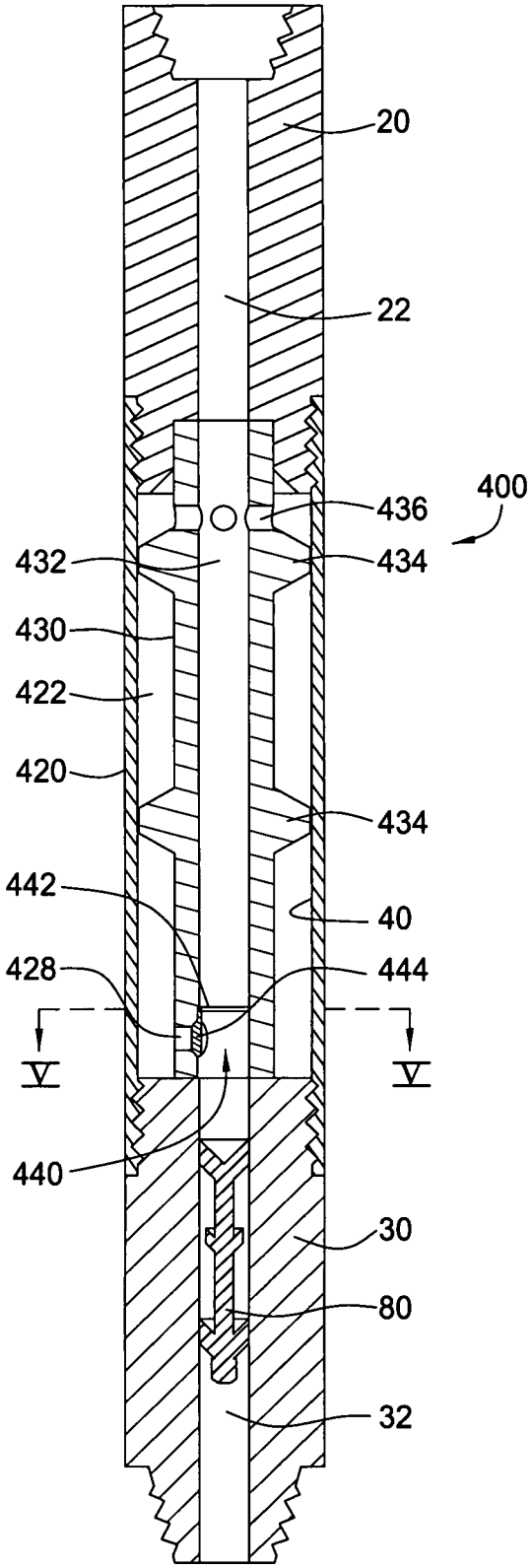
FIG. 9C is a cross-sectional view of the plug-dropping container of FIG. 9A, in its plug-released position. Here, the flapper has been rotated from a plug-retained position to its plug-released position. It can be seen that the dart is now being released into a wellbore there below.

FIG. 9C is a cross-sectional view of the plug-dropping container 400 of FIG. 9A, in its plug-released position. Here, the flapper 444 has been rotated from its plug-retained position against the seat 442 to its plug-released position. It can be seen that the dart 80 is now being released into a wellbore there below. When the flapper 444 is rotated into the plug-released position, the flapper 444 covers the lower bypass port 428. To this end, the outer surface of the flapper 444 is dimensioned to be received against the lower port 428 for sealing and for diverting fluid through the canister channel 432.

Figure 9D:
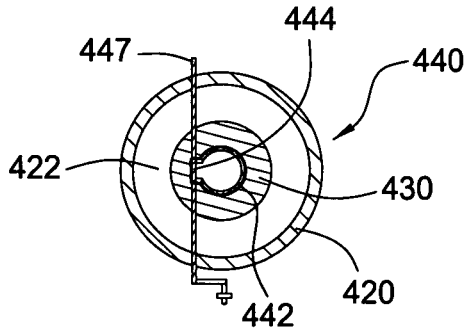
FIG. 9D provides a cross-sectional view of the plug-dropping container of FIG. 9C, with the view taken through line V—V of FIG. 9C. It can be more clearly seen that the flapper has been rotated from its plug-retained position against the seat to its plug-released position covering the bypass opening.

FIG. 9D is a cross-sectional view of the plug-dropping container 400 of FIG. 9C, with the view taken through line D—D of FIG. 9C. It can be more clearly seen that the flapper 444 has been translated from its plug-retained position to its plug-released position.

Figure 10A:
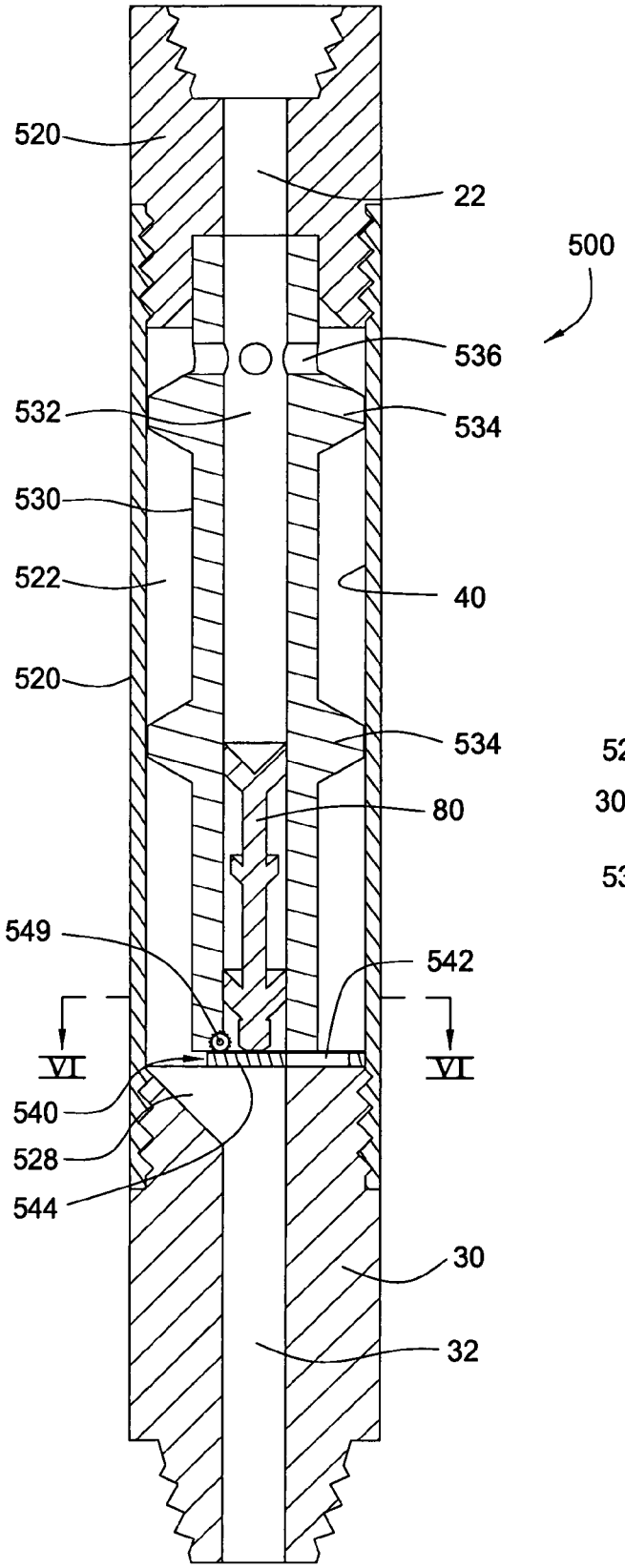
FIG. 10A is a cross-sectional view of yet another embodiment of a plug-dropping container 500 of the present invention. In this arrangement, the plug-retaining device 540 is a horizontal plate. Here, the plate 540 is in its closed position, preventing the downward release of the dart 80. Similar to other embodiments, a canister 530 is centralized within a tubular housing 520 by a spacer 534 (centralizer).

FIG. 10A is a cross-sectional view of yet another embodiment of a plug-dropping container 500 of the present invention. In this arrangement, the plug-retaining device 540 is a horizontal plate. Here, the plate 540 is in its closed position, preventing the downward release of the dart 80.

Figure 10B:
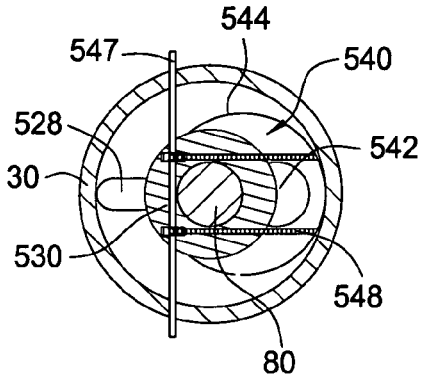
FIG. 10B presents a transverse view of the plug-dropping container of FIG. 10A. The view is taken through line VI—VI of FIG. 10A. Visible in this view is the plate, and a shaft and gear for moving the plate horizontally.

FIG. 10B presents a transverse view of the plug-dropping container 500 of FIG. 10A. The view is taken through line B—B of FIG. 10A. Visible in this view is the plate 540, and a shaft 547 for moving the plate 540 horizontally. It can be seen that the plate 540 has a solid surface 544, and teeth 548 on at least one side of the solid surface 544. The teeth 548 interact with at least one gear 549 (seen in FIG. 10A) for moving the plate 540. The shaft 547 extends through the housing 520 of the container 500, permitting the operator to actuate the plate 540. In this respect, rotation of the shaft 547 imparts rotational movement to the gear 549. This, in turn, drives the plate 540 between its plug-retained and plug-released positions.

The plate 540 includes a through-opening 542 that serves as the channel for receiving a dart 80. The through-opening 542 is offset from center. In the plug-retained position for the plate 540, the through-opening 542 is disposed outside of the longitudinal axis of the canister channel 532. In this manner, the dart 80 is retained by the solid surface 544 of the plate 540, and fluid flow through the canister 532 is substantially blocked. At the same time, fluid may travel through the upper bypass ports 536, through the annular region 522, around the plate 540, through a through a lower bypass area 528 below the canister 530, and then through the channel 32 for the lower head 30. In this manner, fluid may be injected into the wellbore without releasing the dart 80. However, when the plate 540 is moved to its plug-released position, the through-opening 542 of the plate 540 is aligned with the canister channel 532. At the same time, the solid surface 544 of the plate 540 blocks the flow of fluids through the bypass area 528. In this manner, fluid urges the dart 80 to be released into the wellbore.

Figure 10C:
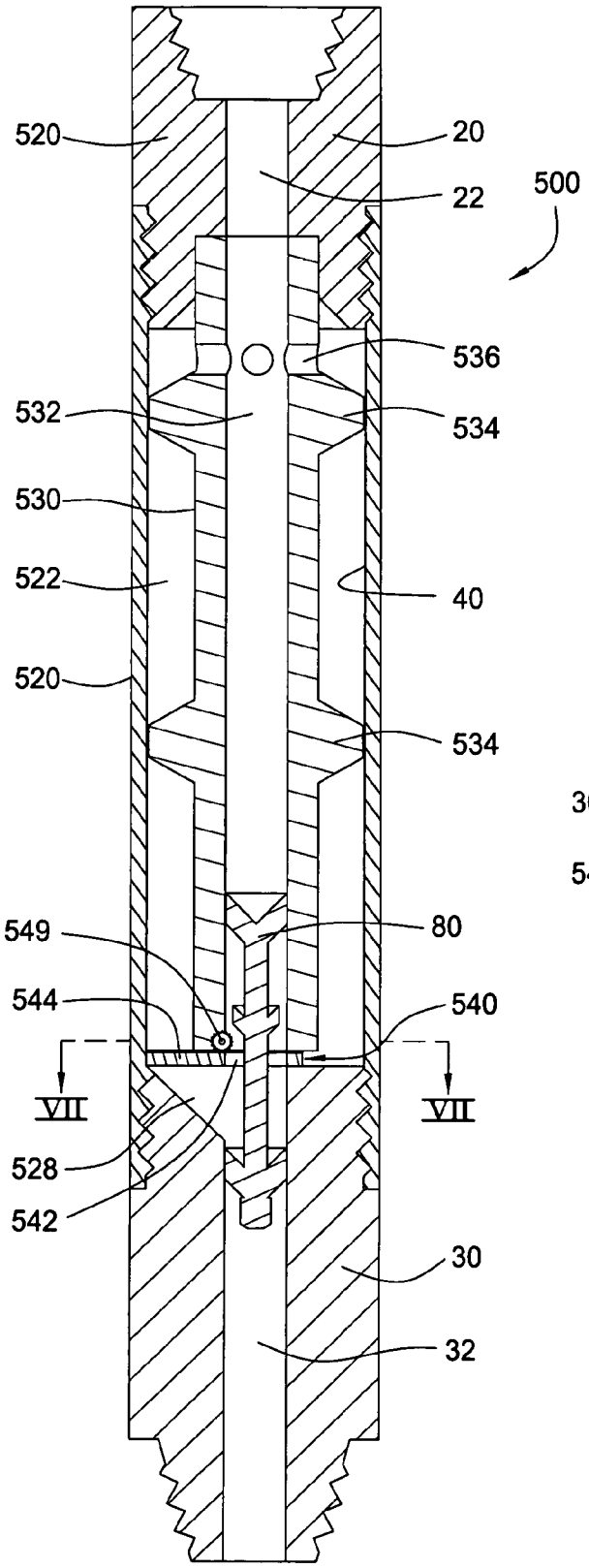
FIG. 10C is a cross-sectional view of the plug-dropping container of FIG. 10A, in its plug-released position. Here, the plate has been translated from a plug-retained position to its plug-released position. It can be seen that the dart is now being released into a wellbore there below.

FIG. 10C is a cross-sectional view of the plug-dropping container 500 of FIG. 10A, in its plug-released position. Here, the plate 540 has been translated from its plug-retained position to its plug-released position. It can be seen that the dart 80 is now being released into a wellbore there below.

Figure 10D:
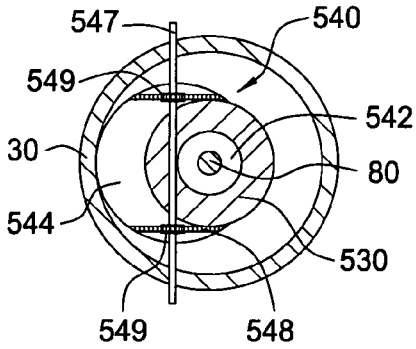
FIG. 10D provides a cross-sectional view of the plug-dropping container of FIG. 10D, with the view taken through line VII—VII of FIG. 10D. It can be more clearly seen that the plate has been translated from its plug-retained position to its plug-released position.

FIG. 10D is a cross-sectional view of the plug-dropping container 500 of FIG. 10C, with the view taken through line D—D of FIG. 10C. It can be more clearly seen that the plate 540 has been translated from its plug-retained position to its plug-released position.

While the foregoing is directed to embodiments of the present invention, other and further embodiments of the invention may be devised without departing from the basic scope thereof, and the scope thereof is determined by the claims that follow. In this respect, it is within the scope of the present invention to use the plug containers disclosed herein to place plugs for various cleaning and fluid circulation procedures in addition to cementing operations for liners. In addition, the plug-dropping container of the present invention has utility in the context of deploying darts or plugs for the purpose of initiating subsea release of wiper plugs. It is further within the spirit and scope of the present invention to utilize the plug-dropping container disclosed herein for dropping items in addition to drill pipe darts and other plugs. Examples include, but are not limited to, balls and downhole bombs.

The invention claimed is:

1. A plug-dropping container within a head member for releasing an object into a wellbore, the plug-dropping container comprising:

a tubular housing;

a tubular canister disposed within and generally aligned with the tubular housing by at least one centralizing member so as to define an annulus between the tubular housing and the canister, the centralizing member configured to allow fluid flow through the annulus;

a channel along the inner surface of the canister, the canister channel being configured to receive the object therein; and a valve disposed within the tubular housing proximal to the lower end of canister, the valve having a solid surface, and having a channel through the valve;

wherein the valve is movable from an object-retained position to an object-released position such that (1) in its object-retained position, the solid surface of the valve substantially blocks the object from exiting the canister but fluids are permitted to flow around the valve, and (2) in its object-released position, the channel of the valve is in substantial alignment with the channel of the canister thereby permitting the object to exit the canister and to travel downward through the channel of the valve, and the solid surface of the valve substantially blocks the flow of fluid around the valve.

2. The plug-dropping container of claim 1, wherein the object is a plug.

3. The plug-dropping container of claim 2, wherein the plug is a dart.

4. The plug-dropping container of claim 1, wherein the tubular housing comprises a top opening and a bottom opening, and wherein the housing is in fluid communication with a channel in the head member through which fluids are circulated into the wellbore.

5. The plug-dropping container of claim 4, wherein the canister further comprises:

a top opening;

a bottom opening; and a bypass area for placing the inner surface of the canister in fluid communication with the annulus between the housing and the canister.

6. The plug-dropping container of claim 5, wherein the bypass defines at least one port disposed in the canister.

7. The plug dropping container of claim 5, wherein the bypass defines a gap between the top opening of the canister and the head member.

8. The plug-dropping container of claim 5, wherein the head member is a cementing head.

9. The plug-dropping container of claim 1, wherein:

the solid surface of the valve defines a radial surface; and the valve has a truncated portion so as to disrupt the radial surface around the valve channel, thus providing a means for bypass flow past the valve when the valve is in its object-retained position.

10. The plug-dropping container of claim 9, wherein the radial surface of the valve is rotated into close proximity with a lower opening in the canister so that it blocks release of the object when the valve is in its object-retained position.

11. The plug-dropping container of 10, wherein the valve is spherical in shape.

12. The plugdropping container of claim 11, further comprising a stop member for limiting rotation of the valve to approximately 90 degrees.

13. The plug-dropping container of claim 12, wherein rotation of the retaining valve is via a shaft.

14. The plug-dropping container of claim 13, wherein rotation of the valve is accomplished manually.

15. The plug-dropping container of claim 13, wherein rotation of the valve is power driven.

16. The plug-dropping container of claim 9, wherein the means for bypass flow is a gap defined between the truncated portion and the tubular housing.

17. The plug-dropping container of 1, wherein the valve defines a plate.

18. The plug-dropping container of 17, wherein the plate comprises:

a solid portion as the solid surface; and a through-opening offset from the solid portion to serve as the channel.

19. The plug-dropping container of 18, wherein the plate further comprises:

teeth along at least one side of the plate for interacting with a gear.

20. The plug-dropping container of 1, wherein the valve defines a flapper valve.

21. The plug-dropping container of 20, wherein:

the flapper valve comprises a solid curved flapper to serve as the solid surface, and a seat to serve as the channel;

the canister comprises a lower bypass port positioned below the flapper valve; and the flapper valve further comprises a shaft for rotating the flapper from (1) an object-retained position such that the flapper blocks the downward release of the object from the canister to an object-released position but permits fluid to flow from the annulus, around the flapper, and through the lower bypass port, to (2) an object-released position such that the flapper substantially seals the lower bypass port and the seat receives the object.

22. The plug-dropping container of claim 1, wherein the at least one centralizing member is formed on the tubular canister.

23. The plug-dropping container of claim 1, wherein the at least one centralizing member is attached to the tubular housing.

24. A plug-dropping container for dispensing plugs into a wellbore during a cementing operation, the plug-dropping container being connected to a cementing head having a fluid flow channel therein for receiving fluids, the plug-dropping container, comprising:

a tubular housing having a top opening and a bottom opening, the housing being in fluid communication with the bore in the cementing head;

an upper canister disposed within and generally aligned with the housing by at least one centralizing member formed on the upper canister so as to define an upper annulus between the tubular housing and the upper canister, the upper canister also having a top opening and a bottom opening;

a channel within the upper canister, the channel of the upper canister being configured to receive a top plug therein;

an upper bypass proximate to the top opening of the upper canister for permitting fluid to flow into the upper annulus;

an upper plug-retaining valve disposed within the housing proximal to the bottom opening of the upper canister, the upper plug-retaining valve having a solid surface, and having a channel through the valve;

a lower canister disposed within and generally aligned with the housing by at least one centralizing member formed on the lower canister and below the upper plug-retaining valve so as to define a lower annulus between the housing and the lower canister, the lower canister also having a top opening and a bottom opening;

a channel within the lower canister, the channel of the lower canister being configured to receive a bottom plug therein;

a lower bypass proximate to the top opening of the lower canister for permitting fluid to flow into the lower annulus;

a lower plug-retaining valve disposed within the housing below the bottom opening of the lower canister, the lower plug-retaining valve having a solid surface, and having a channel through the valve;

wherein the lower plug-retaining valve is movable from a plug-retained position to a plug-released position such that (1) in its plug-retained position, the solid surface of the lower valve substantially blocks the plug from exiting the lower canister, but fluids are permitted to flow around the lower valve, and (2) in its plug-released position, the channel of the lower valve is in substantial alignment with the channel of the lower canister thereby permitting the plug to exit the lower canister and to travel downward through the channel of the lower valve, and the solid surface of the valve substantially blocks the flow of fluid around the valve; and wherein the upper plug-retaining valve is movable from a plug-retained position to a plug-released position such that (1) in its plug-retained position, the solid surface of the upper valve substantially blocks a plug bottom from exiting the lower canister, but fluids are permitted to flow around the lower valve, and (2) in its plug-released position, the channel of the upper valve is in substantial alignment with the channel of the upper canister thereby permitting the plug to exit the upper canister and to travel downward through the channel of the upper valve, and the solid surface of the valve substantially blocks the flow of fluid around the valve.

25. The plug-dropping container of claim 24, wherein the plug is a dart.

26. The plug-dropping container of claim 25, wherein each of the upper and lower canisters further comprises:

a top opening;

a bottom opening; and a bypass area for placing the inner surface of the respective canister in fluid communication with the annulus between the housing and the canister.

27. The plug-dropping container of claim 26, wherein the bypass area defines at least one port disposed in the canister.

28. The plug dropping container of claim 26, wherein the bypass area defines a gap between the top opening of the respective canister and the cementing head.

29. The plug-dropping container of claim 24, wherein:

the solid surface of the upper and lower valves defines a radial surface; and each of the valves has a truncated portion so as to disrupt the radial surface around the respective valve channels, thus providing a means for bypass flow past the valves when the valves are in their respective plug-retained positions.

30. The plug-dropping container of claim 29, wherein the radial surfaces of the respective valves is rotated into close proximity with a lower opening in the upper and lower canisters, respectively, so as to block release of the upper and lower plugs when the upper and lower valves are in their respective plug-retained positions.

31. The plug-dropping container of 30, wherein the upper and lower valves are each spherical in shape.

32. The plug-dropping container of claim 31, further comprising upper and lower stop members for limiting rotation of the upper and lower valves, respectively, to approximately 90 degrees.

33. The plug-dropping container of 24, wherein at least one of the upper and lower valves defines a plate.

34. The plug-dropping container of 33, wherein the plate comprises:

a solid portion as the solid surface; and a through-opening offset from the solid portion to serve as the channel.

35. The plug-dropping container of 34, wherein the plate further comprises:

teeth along at least one side of the plate for interacting with a gear.

36. The plug-dropping container of 24, wherein the at least one of the upper and lower valves defines a flapper valve.

37. The plug-dropping container of 36, wherein:

the flapper valve comprises a solid curved flapper to serve as the solid surface, and a seat to serve as the channel;

the canister comprises a lower bypass port positioned below the flapper valve;

and the flapper valve further comprises a shaft for rotating the flapper from (1) an object-retained position such that the flapper blocks the downward release of the object from the canister to an object-released position but permits fluid to flow from the annulus, around the flapper, and through the lower bypass port, to (2) an object-released position such that the flapper substantially seals the lower bypass port and the seat receives the plug.

38. A plug-dropping container within a head member for releasing an object into a wellbore, the plug-dropping container comprising:

a tubular housing;

a tubular canister disposed within and generally aligned with the tubular housing so as to define an annulus between the tubular housing and the canister, the canister having an inner surface;

a channel along the inner surface of the canister, the canister channel being configured to receive the object therein; and a valve disposed within the tubular housing proximal to the lower end of canister, the valve having a solid radial surface, and having a channel through the valve;

wherein the valve is rotatable from an object-retained position to an object-released position such that (1) in its object-retained position, the radial surface of the valve substantially blocks the object from exiting the canister and the radial surface contacts and creates a seal with the tubular canister to substantially close fluid flow through the channel, and (2) in its object-released position, the channel of the valve is in substantial alignment with the channel of the canister thereby permitting the object to exit the canister and to travel downward through the channel of the valve and opens fluid flow through the channel, and wherein the radial surface around a perimeter of one end of the valve channel is placed in close proximity with the lower channel of the head member where it substantially blocks the flow in the annulus between the tubular housing and the canister in the object-released position.

39. The plug-dropping container of 38, wherein the valve is spherical in shape.

40. The plug-dropping container of 38, wherein the valve further comprises a bypass region which allows fluid to flow from the housing annulus to the lower channel of the head member when the valve is in its object-retained position.

41. The plug-dropping container of claim 40, wherein the valve bypass region comprises a truncated portion of the radial surface.

42. The plug-dropping container of claim 40, wherein the valve bypass region comprises at least one opening through the radial surface.

43. The plug-dropping container of claim 38, further comprising a stop member for limiting rotation of the valve to approximately 90 degrees.

44. A plug-dropping container within a head member for releasing an object into a wellbore, the plug-dropping container comprising:

a tubular housing;

a tubular canister disposed within and generally aligned with the tubular housing so as to define an annulus between the tubular housing and the canister, the canister having an inner surface;

a channel along the inner surface of the canister, the canister channel being configured to receive the object therein; and a valve disposed within the tubular housing proximal to the lower end of canister, the valve defining a plate comprising a solid surface and a channel offset from the solid surface;

wherein the valve is movable from an object-retained position to an object-released position such that (1) in its object-retained position, the solid surface of the valve blocks the object from exiting the canister, and (2) in its object-released position, the channel of the valve is in substantial alignment with the channel of the canister thereby permitting the object to exit the canister and to travel downward through the channel of the valve.

45. The plug-dropping container of claim 44, wherein fluids are permitted to flow from the housing annulus, around the plate, to the lower channel of the head member when the valve is in its object-retained position, but such flow is substantially blocked by the solid surface of the plate when the plate is in its object-retained position.

46. The plug-dropping container of claim 44, wherein fluids are permitted to flow from the housing annulus, through at least one channel in the plate, to the lower channel of the head member when the valve is in its object-retained position, but such flow is substantially blocked by the solid surface of the plate when the plate is in its object-retained position.

47. The plug-dropping container of claim 44, wherein the plate further comprises:

teeth along at least one side of the plate for interacting with a gear.

48. A plug-dropping container within a head member for releasing an object into a wellbore, the plug-dropping container comprising:

a tubular housing;

a tubular canister disposed within and generally aligned with the tubular housing so as to define an annulus between the tubular housing and the canister, the canister having an inner surface and a lower bypass port;

a channel along the inner surface of the canister, the canister channel being configured to receive the object therein; and a flapper valve disposed within the tubular housing proximal to the lower end of the canister but above the lower bypass port, the flapper valve comprising a solid curved flapper, a shaft for rotating the flapper, and a seat to serve as the channel;

wherein the shaft is rotatable to move the flapper valve from an object-retained position to an object-released position such that (1) in its object-retained position, the curved flapper of the valve substantially blocks the object from exiting the canister, but fluids are permitted to flow around the flapper and through the lower bypass port, and (2) in its object-released position, the flapper moves to permit the object to exit the canister and to travel downward through the seat, and substantially seals the lower bypass port.

49. A plug-dropping container within a head member for releasing an object into a wellbore, the plug-dropping container comprising:

a tubular housing;

a tubular canister disposed within the tubular housing, the canister having a channel configured to receive the object therein; and a valve disposed proximate an end of the canister, the valve having a substantially radial surface capable of contacting and creating a seal with the tubular canister to substantially close fluid flow through the channel and the valve having a substantially flat surface, wherein the valve is movable from an object-retained position and an object-released position, whereby in the object retained position fluids are permitted to flow around the valve through a gap defined between the flat surface and the tubular housing.

50. The plug-dropping container of claim 49, wherein the solid radial surface of the valve substantially blocks the object from exiting the canister in the object-retained position.

* * * * *